US007293564B2

(12) United States Patent
Perfetti et al.

(10) Patent No.: US 7,293,564 B2
(45) Date of Patent: Nov. 13, 2007

(54) METHOD FOR CHEMICALLY MODIFYING TOBACCO DURING CURING

(75) Inventors: Thomas Albert Perfetti, Winston-Salem, NC (US); Watson Minyard Dufour, Winston-Salem, NC (US); Stephen Keith Cole, Winston-Salem, NC (US); William Monroe Coleman, III, Winston-Salem, NC (US); Marvin Glenn Riddick, Winston-Salem, NC (US); Wennuan Liu, Clemmons, NC (US); Paul Andrew Brinkley, Winston-Salem, NC (US)

(73) Assignee: R. J. Reynolds Tobacco Company, Winston-Salem, NC (US)

( * ) Notice: Subject to any disclaimer, the term of this patent is extended or adjusted under 35 U.S.C. 154(b) by 616 days.

(21) Appl. No.: 10/459,123

(22) Filed: Jun. 11, 2003

(65) Prior Publication Data

US 2004/0250821 A1 Dec. 16, 2004

(51) Int. Cl.
*A24B 3/18* (2006.01)

(52) U.S. Cl. ..... 131/296; 131/290

(58) Field of Classification Search ..... 131/290, 131/296; 432/500
See application file for complete search history.

(56) References Cited

U.S. PATENT DOCUMENTS

| | | | | |
|---|---|---|---|---|
| 48,689 | A | 7/1865 | Huse | |
| 246,975 | A * | 9/1881 | Philips | 131/309 |
| 457,029 | A | 8/1891 | Johns | |
| 1,168,029 | A | 1/1916 | Probst | |
| 1,262,622 | A | 4/1918 | Bedortha | |
| 1,768,142 | A | 6/1930 | Pike et al. | |
| 1,847,162 | A | 3/1932 | Andrews | |
| 2,108,305 | A | 2/1938 | Coe | |
| 2,108,860 | A * | 2/1938 | Kauffman | 502/62 |
| 2,128,043 | A | 8/1938 | Garner | |
| 2,164,030 | A | 6/1939 | Coe | |
| 2,475,568 | A | 7/1949 | Moore, Jr. | |
| 2,708,441 | A | 5/1955 | Viglione | |
| 2,758,603 | A | 8/1956 | Heljo | |
| 2,822,306 | A | 2/1958 | Thienemann et al. | |
| 3,742,692 | A | 7/1973 | Bense | |
| 3,821,960 | A | 7/1974 | Egri | |
| 3,937,227 | A * | 2/1976 | Azumano | 131/302 |
| 4,011,041 | A | 3/1977 | Taylor | |
| 4,114,288 | A | 9/1978 | Fowler | |
| 4,192,323 | A | 3/1980 | Horne | |
| 4,607,646 | A | 8/1986 | Lilly, Jr. et al. | |
| 4,628,947 | A | 12/1986 | Driscoll et al. | |
| 4,744,375 | A | 5/1988 | Denier et al. | |
| 4,827,949 | A | 5/1989 | Sunas | |
| 5,445,169 | A | 8/1995 | Brinkley et al. | |
| 6,202,649 | B1 | 3/2001 | Williams | |
| 6,425,401 | B1 | 7/2002 | Williams | |
| 6,564,808 | B1 * | 5/2003 | Hempfling et al. | 131/297 |
| 2001/0000386 | A1 | 4/2001 | Peele | |
| 2004/0144397 | A1 * | 7/2004 | Conkling | 131/347 |

OTHER PUBLICATIONS

Brown, O., et al., "Engineering Phases of Curing Bright Leaf Tobacco," *Agricultural Engineering*, 1948, vol. 29(3), pp. 109-111.
Cooper, A., et al., "Drying and Curing of Bright Leaf Tobacco by Means of Conditioned Air," *Virginia Polytechnic Institute Bulletin*, 1939, vol. 32(6), pp. 3-28.
Johnson, W., "Curing," *Rec. Adv. Tob. Sci.,* 1974, Inaug. vol., pp. 63-78.
Johnson, W., et al., "Bulk Curing of Bright Leaf Tobacco," *Tobacco Science*, 1960, vol. 4, pp. 49-55.
Peele, D., et al., "Chemical and Biochemical Changes during the Flue-Curing of Tobacco," *Rec. Adv. Tob. Sci.,* 1995, vol. 21, pp. 81-133.
Sisler, E., et al., "Effect of Ethylene and Cyclic Olefins on Tobacco Leaves," *Tobacco Science*, 1973, vol. 17, pp. 68-72.
Walker, E., et al., "Physical and Chemical Characteristics of Flue-Cured Tobacco Cured with and without Ethylene Gas," *Tobacco Science*, 1985, vol. 29, pp. 92-98.
Watkins, R., et al., "Effects of Oxygen Stress on Tobacco Discoloration," *Tobacco Science*, 1962, vol. 6, pp. 92-97.

* cited by examiner

*Primary Examiner*—Dionne W. Mayes
(74) *Attorney, Agent, or Firm*—Alston & Bird LLP

(57) ABSTRACT

A method for chemically modifying a tobacco material during a curing process involves treating the tobacco material in a curing enclosure at a temperature and for a time sufficient to produce cured tobacco. The method also involves contacting the tobacco material with a chemical reagent before and/or during the time period that the tobacco material is cured so that the chemical reagent can interact with the tobacco material, thus resulting in further change in the chemical nature of the cured tobacco material. An exemplary chemical reagent is an ammonia source, which can be applied to a tobacco material in a variety of ways, including by spraying an aqueous ammonia source onto the tobacco or by introducing gaseous ammonia into the curing enclosure during the curing process.

43 Claims, No Drawings

METHOD FOR CHEMICALLY MODIFYING TOBACCO DURING CURING

FIELD OF THE INVENTION

The invention relates to tobacco, and in particular, to methods for altering the chemical nature of tobacco during the tobacco curing process.

BACKGROUND OF THE INVENTION

Popular smoking articles, such as cigarettes, have a substantially cylindrical rod shaped structure and include a charge, roll or column of smokable material such as shredded tobacco (e.g., in cut filler form) surrounded by a paper wrapper thereby forming a so-called "tobacco rod." Normally, a cigarette has a cylindrical filter element aligned in an end-to-end relationship with the tobacco rod. Typically, a filter element comprises plasticized cellulose acetate tow circumscribed by a paper material known as "plug wrap." Certain cigarettes incorporate a filter element having multiple segments, and one of those segments can comprise activated charcoal particles. Typically, the filter element is attached to one end of the tobacco rod using a circumscribing wrapping material known as "tipping paper." It also has become desirable to perforate the tipping material and plug wrap, in order to provide dilution of drawn mainstream smoke with ambient air. A cigarette is employed by a smoker by lighting one end thereof and burning the tobacco rod. The smoker then receives mainstream smoke into his/her mouth by drawing on the opposite end (e.g., the filter end) of the cigarette.

The tobacco used for cigarette manufacture is typically used in blended form. For example, certain popular tobacco blends, commonly referred to as "American blends," comprise mixtures of flue-cured tobacco, burley tobacco and Oriental tobacco, and in many cases, certain processed tobaccos, such as expanded tobacco, reconstituted tobacco and processed tobacco stems. The precise amount of each type of tobacco within a tobacco blend used for the manufacture of a particular cigarette brand varies from brand to brand. See, for example, *Tobacco Encyclopedia*, Voges (Ed.) p. 44-45 (1984), Browne, *The Design of Cigarettes*, 3rd Ed., p. 43 (1990) and *Tobacco Production, Chemistry and Technology*, Davis et al. (Eds.) p. 346 (1999).

It has been common practice to flue-cure certain tobaccos, such as Virginia tobaccos, in barns using a so-called flue-curing process. Cooper et al., *VPI Bull.*, 37(6), 3-28 (1939); Brown et al., *Agric. Eng.*, 29(3), 109-111 (1948); Johnson et al., *Job. Sci.*, 4, 49-55 (1960); Johnson, *Rec. Adv. Tob. Sci.*, Inag. Vol., 63-78 (1974); Peele et al., *Rec. Adv. Job. Sci.*, 21, 81-123 (1995). Tobacco leaf is harvested, placed in barns, and subjected to the application of heat in order to dry and "cure" the tobacco.

There have been reports of investigations associated with curing conditions within tobacco curing barns. See, for example, U.S. Pat. No. 1,768,142 to Pike et al. Carbon dioxide levels within tobacco curing structures during tobacco curing processes have been monitored. See, Johnson et al., *Tob. Sci.*, 7, 85-92 (1963). Changes in oxygen levels within the atmospheres within tobacco curing structures also have been monitored. See, Watkins et al., *Tob. Sci.*, 6, 92-97 (1962). It has been suggested to introduce oxygen into tobacco curing barns during the flue-curing process. See, U.S. Pat. No. 2,708,441 to Viglione. The effects of chemicals, such ethylene, on tobacco during the flue-curing process also have been studied. See, Sisler et al., *Tob. Sci.*, 17, 68-72 (1973) and Walker et al., *Tob. Sci.*, 29, 92-98 (1985). Nitrous oxides in exhaust gases, particularly from direct fire liquid propane powered heating units, have been implicated with the formation of tobacco specific nitrosamines (TSNA) in flue-cured Virginia tobacco. See, US Pat. App. Pub. 2001/0000386 to Peele and U.S. Pat. No. 6,564,808 to Hempfling et al., which are incorporated herein by reference.

During the growing season, numerous environmental factors, such as the amount of rainfall, can impact the chemical properties of tobacco. For instance, in drought conditions, harvested tobacco leaves exhibit higher nicotine levels and lower levels of carbohydrates; and cured tobacco leaves exhibit higher nicotine levels and lower levels of sugars that serve as precursors to aromatic and flavorful compounds (e.g., pyrazines). In growing seasons where rainfall is above average, harvested tobacco leaves contain greater amounts of carbohydrates, and a more moderate nicotine concentration. As a result, due to the volatile and unpredictable nature of the environmental conditions experienced by the tobacco during the growing season, the chemical properties of harvested tobacco and cured leaf are rarely consistent from one year to the next.

It would be desirable to provide an efficient and effective method for chemically modifying tobacco at an early stage of production, such as during the curing process. It would be particularly desirable to adjust the chemical properties of tobacco in a manner that provides greater consistency despite changes in environmental factors from year-to-year.

SUMMARY OF THE INVENTION

The present invention provides a method for chemically modifying tobacco during the curing process by contacting the tobacco with a chemical reagent such that the chemical reagent interacts with the tobacco material during the curing process. The chemical reagent, through the amount used and under the conditions used, is capable of influencing or adjusting the character, nature or chemical properties of tobacco, and most preferably to a significant degree. For instance, certain preferred chemical reagents are capable of interacting with the tobacco so as to reduce the nicotine content of that tobacco and/or increase the concentration of certain desirable precursors to flavorful and aromatic compounds (e.g., amino sugar compounds). Thus, the present invention provides manners or methods for reducing the nicotine content of tobacco materials, as well as tobacco materials possessing desirable flavorful components that are the reaction products of the chemical reagent and carbohydrate components of the tobacco material.

The manner in which the chemical reagent contacts the tobacco material can vary. However, it is highly preferred that the chemical reagent be in intimate contact with at least a portion (and most preferably essentially all) of the tobacco. At some point during the curing process, the chemical reagent can contact the surface of the tobacco, and the chemical reagent also can be introduced within the tobacco. The method of contacting the tobacco with the chemical reagent can involve spraying a liquid chemical reagent onto the tobacco prior to or during the curing process. The method of contacting the tobacco with the chemical reagent can involve introducing a liquid chemical reagent (or components that evaporate from a liquid chemical reagent) into the atmosphere within the curing enclosure, chamber or structure during the curing process. The method of contacting the tobacco with the chemical reagent can involve introducing a gaseous chemical reagent into the curing enclosure, chamber or structure prior to or during the curing process. The method of contacting the tobacco with the chemical reagent can involve introducing a solid chemical reagent into the curing enclosure, chamber or structure and thermal decomposition or sublimation of that solid chemical reagent during the curing process, resulting in the formation of a gaseous chemical reagent that interacts with the tobacco. Although less preferred, the tobacco material can be contacted with the chemical reagent during or after harvest. Although less preferred, the chemical reagent can be introduced into the tobacco during the growing season and prior to harvest (e.g., as by applying the chemical reagent with fertilizer).

The method of the present invention can be practiced without significantly altering conventional methods of tobacco harvesting and curing. The present invention provides an efficient and effective method of altering the chemical nature of tobacco, particularly flue-cured tobacco, and as such, the present invention provides and efficient and effective method for providing cured tobacco of improved quality and improved smoking character. The present invention can be carried out in a manner that provides minimal disruption of the conventional procedures for harvesting and curing tobacco. For instance, the present invention does not require substantial or significant changes to the equipment or procedures conventionally used for tobacco curing, and can be practiced using conventional curing barns that are operated in essentially traditional manners.

In one aspect, the present invention provides a method of chemically modifying a tobacco material during the curing process by placing a tobacco material in a curing enclosure, such as a conventional curing barn, treating the tobacco material at a temperature and for a time sufficient to produce cured tobacco, and contacting the tobacco material with a chemical reagent before and/or during such treatment in such a manner that the chemical reagent has the ability to interact with that tobacco material. In this manner, the chemical reacts with the tobacco material during such treatment (i.e., during curing). In preferred embodiments, the chemical reagent has an acidic character (e.g., acetic acid) or a basic character (e.g., ammonia). It also is preferred that the type of chemical reagent, the amount of chemical reagent, and the treatment conditions associated with the curing of the tobacco material, be such that the sensory properties and attributes associated with that tobacco are altered.

In one embodiment, the chemical reagent is an ammonia source, including any solid, liquid, or gaseous source of ammonia. The ammonia may be applied to the tobacco material in any conventional manner, such as by spraying an aqueous ammonia source onto the tobacco prior to or during the curing process, by thermally decomposing a solid source of ammonia during the curing process, or by introducing a gaseous ammonia source into the curing enclosure prior to or during the curing process. As a result, it is possible to produce a cured tobacco material having desirable sensory attributes as well as reduced nicotine content.

DETAILED DESCRIPTION OF THE PREFERRED EMBODIMENTS

The present invention now will be described more fully hereinafter. This invention may, however, be embodied in many different forms and should not be construed as limited to the embodiments set forth herein; rather, these embodiments are provided so that this disclosure will be thorough and complete, and will fully convey the scope of the invention to those skilled in the art.

The present invention provides a method for modifying the chemical nature of tobacco by contacting the tobacco with a chemical reagent either before or during a curing process. The chemical reagent is contacted with the tobacco in such an amount, at such a time, for such a period, and under such conditions, that the chemical reagent reacts with the tobacco during the curing process in order to provide some change in the chemical composition, and overall nature and character, of that tobacco. In this manner, an effective and efficient method for altering the chemical nature of tobacco at a very early stage of tobacco production is provided without significantly disrupting those steps involved in conventional tobacco harvesting and curing methods. The present invention can be practiced with only minor modification of existing tobacco curing procedures and equipment. Minor modifications include, for example, taking steps to minimize or avoid interaction (e.g., corrosion) of components of curing equipment due to exposure to particular chemical reagents.

The tobacco that is cured in accordance with the present invention can vary. Typically, the tobacco that is cured in accordance with the present invention is Virginia tobacco, and that tobacco is subjected to flue-curing conditions. However, any tobacco subjected to a curing process involving the application of heat (e.g., a modified air-curing process) can be used in carrying out the present invention. Most preferably, the tobacco is cured within a closed curing structure, such as a curing barn associated with the flue-curing of Virginia tobacco.

Most preferably, the tobacco that is cured in accordance with the present invention is a Virginia tobacco. The varieties of Virginia tobacco that can be grown and cured in accordance with the present invention will be readily apparent to those skilled in the art of tobacco growing, harvesting and processing, and tobacco product manufacture. Representative flue-cured or Virginia tobaccos include Coker 48, Coker 176, Coker 371-Gold, Coker 319, Coker 347, GL 939, K 149, K 326, K 340, K 346, K 358, K 394, K 399, K 730, NC 27NF, NC 37NF, NC 55, NC 60, NC 71, NC 72, NC 82, NC 95, NC 297, NC 606, NC 729, NC 2326, McNair 373, McNair 944, Ox 207, Ox 414 NF, Reams 126, Reams 713, Reams 744, RG 8, RG 11, RG 13, RG 17, RG 22, RG 81, RG H4, RG H51, Speight H-20, Speight G-28, Speight G-58, Speight G-70, Speight G-108, Speight G-111, Speight G-117, Speight 168, Speight 179, Speight NF-3, Va 116 and Va 182.

The manner in which Virginia tobacco is grown, harvested and processed is well known. See, Garner, *USDA Bulletin No*. 143, 7-54 (1909); Darkis et al, *Ind. Eng. Chem*., 28, 1214-1223 (1936); Bacon et al., *USDA Tech. Bulletin No*. 1032 (1951); Darkis et al., *Ind. Eng. Chem*., 44, 284-291 (1952); Bacon et al., *Ind. Eng. Chem*., 44, 292-309 (1952); *Curing Flue-Cured Tobacco in Canada*, Publication 1312/E (1987); and Suggs et al., *Tob. Sci*., 33, 86-90 (1989). See, also, Hawks, Jr., *Principles of Flue-Cured Tobacco Production*, $2^{Ed}$. (1978); *Flue-Cured Tobacco Information* 1993, N. C. Coop. Ext. Serv.; and Peele et al., *Rec. Adv. Tob. Sci*., 21, 81-123 (1995). Those references are incorporated herein by reference.

The tobacco that is cured has been harvested. Tobacco that is cured in accordance with the present invention typically is grown under well-known and accepted agronomic conditions, and is harvested using known techniques. Such tobacco typically is referred to as green tobacco. Most preferably, the harvested tobacco is adequately ripe or mature. Peele et al., *Rec. Adv. Tob. Sci*., 21, 81-123 (1995).

Ripe or mature tobaccos typically require shorter cure times than do unripe or immature tobaccos.

The green tobacco is placed in an enclosure adapted for curing tobacco, commonly referred to in the art as a curing barn. Typically, the tobacco can be placed within the barn in racks; or in the case of bulk barns, the tobacco can be placed in boxes. The green tobacco can be placed in the barn in a variety of ways, and typically is carried out as a manner of personal preference. As such, there is wide discretion in the particular determination of the amount of tobacco placed within the barn, the packing density of that tobacco within a box, the spacing of the tobacco within the barn, and the location of various tobacco samples within the barn. See, for example, US Pat. App. Pub. 2001/0000386 to Peele and *Tobacco Production, Chemistry and Technology*, Davis et al. (Eds.) p. 131-133 (1999). Preferably, flue-cured tobaccos are cured using the types of techniques and conditions set forth in US Pat. App. Pub. 2001/0000386 to Peele. Preferred flue-cured tobaccos are stored and aged for at least one year after curing is complete.

The tobacco is subjected to curing conditions, typically involving the application of heat. The curing barn is equipped with a heating source, such as a direct-fire heating unit, but is most preferably equipped with an indirect heating source, such as an electrical heating unit or heat exchanger. The curing barn also typically is equipped with a fan for circulating air within the barn and manual or automated temperature and humidity controls. The exact design of the curing barn and the type of heating source or other process controls employed may vary without departing from the present invention. Exemplary curing barns and methods for curing tobacco using those barns are of the type described in U.S. Pat. No. 1,547,958 to Ring; U.S. Pat. No. 2,082,289 to Hodgin; U.S. Pat. No. 2,134,843 to Rouse; U.S. Pat. No. 2,474,534 to Horne; U.S. Pat. No. 2,475,568 to Moore, Jr.; U.S. Pat. No. 3,110,326 to Hassler; U.S. Pat. No. 3,134,583 to Wilson; U.S. Pat. No. 3,244,445 to Wilson; U.S. Pat. No. 3,251,620 to Hassler; U.S. Pat. No. 3,503,137 to Wilson; U.S. Pat. No. 3,664,034 to Wilson; U.S. Pat. No. 3,669,429 to Dew; U.S. Pat. No. 3,937,227 to Azumano; U.S. Pat. No. 4,011,041 to Taylor; U.S. Pat. No. 4,021,928 to Johnson; U.S. Pat. No. 4,114,288 to Fowler; U.S. Pat. No. 4,192,323 to Horne; U.S. Pat. No. 4,206,554 to Fowler; U.S. Pat. No. 4,247,992 to MacGregor; U.S. Pat. No. 4,267,645 to Hill; U.S. Pat. No. 4,424,024 to Wilson et al. U.S. Pat. No. 4,499,911 to Johnson; U.S. Pat. No. 5,685,710 to Martinez Sagrera et al.; U.S. Pat. No. 6,202,649 to Williams; and U.S. Pat. No. 6,425,401 to Williams; and Canadian Patent No. 1,026,186. In North America, and particularly in the U.S.A., tobacco curing barns are manufactured and supplied by various companies, including Long Manufacturing Inc., Taylor Manufacturing Company, Powell Manufacturing Company, Tharrington Industries, and DeCloet Ltd. Other curing barns are available throughout the world, and exemplary barns can be provided by VenconVarsos of Greece. Tobacco curing barns have been manufactured and operated in traditional manners for many years, and the design, manufacture and use of such barns will be readily apparent to those skilled in the art of tobacco curing.

Typically, a curing barn possesses a roof, four walls and a foundation. Such a barn possesses a furnace area at one end and a tobacco curing region at the other. Normally, the furnace area and tobacco curing region are separated from one another by a wall. Such a barn possesses doors at the curing region end of the barn in order to allow loading of tobacco to, and unloading of tobacco from, that barn. Normally, the barn possesses an air intake damper near its furnace end, and an exhaust damper near doors of its curing region end. Typically, the tobacco is contained in racks or boxes. Preferably, the furnace area of the barn possesses a heat source (e.g., a burner that is fueled by a suitable fuel, such as liquid propane gas (LPG) or fuel oil), a heat exchange unit to providing transfer of heat to within the barn, and a fan. Typically, the fan is located below the heat exchanger. In use, heated air in the region near the heat exchanger is forced downward by the fan, and is forced to flow into a plenum located on the tobacco curing region of the barn. The plenum is located below the tobacco that has been placed in the barn, and the heated air passes through passageways within the floor of the barn. The heated air passes upwards, and hence heats the tobacco. That is, the tobacco is heated be exposure to heated air. A return air vent in the upper region of the wall that separates the furnace region from the tobacco curing region provides for the return of circulated air from the tobacco curing region to the furnace region. A series of nozzles that are connected to a source of water typically are located below the fan; and after curing, the nozzles can be used to spray water that is carried by air flow provided by the action of the fan onto the cured, dry tobacco so as to reorder that tobacco. For tobacco treated in accordance with the present invention, the nozzle system for providing reordering water (or an alternate nozzle system) can be used to supply liquid chemical reagent (e.g., a liquid ammonia hydroxide solution) to the tobacco. For tobacco treated in accordance with the present invention, a nozzle system for inlet of gaseous chemical reactant can be located near the spray nozzles that are used for supplying reordering water, or elsewhere throughout the curing barn. Alternatively, for tobacco treated in accordance with the present invention, a container (e.g., an open pan) for liquid or solid chemical reactant can be located below the fan, or elsewhere throughout the curing barn. As such, it is desirable that the fan be used to assist in transferring to the tobacco the chemical reactant that is located physically separate from the tobacco.

The conditions of temperature to which the tobacco is exposed during curing can vary. The time frame over which curing of the tobacco occurs also can vary. For the flue-curing of Virginia tobaccos, the temperature to which the tobacco is exposed typically is in the range of about 35° C. to about 75° C.; and the time over which the tobacco is exposed to those elevated temperatures usually is at least about 120 hours, but usually is less than about 200 hours. Curing temperatures reported herein are air temperatures that are representative of the average air temperature within the curing barn during curing process steps. Average air temperatures can be taken at one or more points or locations within the curing barn that give an accurate indication of the temperature that the tobacco experiences during curing steps. Typically, Virginia tobacco first is subjected to a yellowing treatment step whereby the tobacco is heated at about 35° C. to about 40° C. for about 24 to about 72 hours, preferably about 36 to about 60 hours; then is subjected to a leaf drying treatment step whereby the tobacco is heated at about 40° C. to about 57° C. for about 48 hours; and then is subjected to a midrib (i.e., stem) drying treatment step whereby the tobacco is heated at about 57° C. to about 75° C. for about 48 hours. Thus, it is preferred that tobacco processed in accordance with the present invention be cured for a total period of about 5 days to about 8 days, typically about 6 days to about 7 days. Temperatures to which the tobacco is exposed during cure typically do not exceed about 90° C., frequently do not exceed about 85° C., and preferably do not exceed about 80° C. Exposing Virginia tobacco to temperatures above about 70° C. to about 75° C. during curing is not desirable, as exposure of the tobacco to exceedingly high temperatures, even for short periods of time, can have the effect of decreasing the quality of the cured tobacco. Typically, some ambient air preferably is introduced into the barn during the yellowing stage, significantly more ambient air preferably is introduced into the barn during the leaf drying stage, and heated air preferably is recirculated within the barn during midrib drying stage. The relative humidity within the barn during curing varies, and is observed to change during curing. Typically, a relative humidity of about 85 percent is maintained within the curing barn during the yellowing stage, but then is observed to decrease steadily during leaf drying and midrib drying stages.

After the tobacco is exposed to curing conditions, heating is ceased. Typically, the fresh air dampers of the barn are opened in order to allow contact of ambient air with that tobacco. As such, moisture within the ambient air is allowed to moisten the tobacco; and the very dry freshly cured tobacco is rendered less brittle. The cooled tobacco then is taken down, and the tobacco is removed from the curing barn.

Cured tobacco is collected, and normally is prepared for sale. After sale, the tobacco typically is de-stemmed in a conventional manner. The tobacco can be stored and aged as is conventional for flue-cured tobacco. Then, the tobacco can be further processed for use in the manufacture of tobacco products. The cured, aged and processed tobacco can be used in a conventional manner for the manufacture of tobacco products, including smoking products such as cigarettes. Representative tobacco blends, representative cigarette components, and representative cigarettes manufactured therefrom, are set forth in U.S. Pat. No. 4,836,224 to Lawson et al.; U.S. Pat. No. 4,924,888 to Perfetti et al.; U.S. Pat. No. 5,056,537 to Brown et al.; U.S. Pat. No. 5,220,930 to Gentry; and U.S. Pat. No. 5,360,023 to Blakley et al.; US Pat. Application 2002/0000235 to Shafer et al.; and PCT WO 02/37990. Those tobacco materials also can be employed for the manufacture of those types of cigarettes that are described in U.S. Pat. No. 4,793,365 to Sensabaugh et al.; U.S. Pat. No. 4,917,128 to Clearman et al.; U.S. Pat. No. 4,947,974 to Brooks et al.; U.S. Pat. No. 4,961,438 to Korte; U.S. Pat. No. 4,920,990 to Lawrence et al.; U.S. Pat. No. 5,033,483 to Clearman et al.; U.S. Pat. No. 5,074,321 to Gentry et al.; U.S. Pat. No. 5,105,835 to Drewett et al.; U.S. Pat. No. 5,178,167 to Riggs et al.; U.S. Pat. No. 5,183,062 to Clearman et al.; U.S. Pat. No. 5,211,684 to Shannon et al.; U.S. Pat. No. 5,247,949 to Deevi et al.; U.S. Pat. No. 5,551,451 to Riggs et al.; U.S. Pat. No. 5,285,798 to Banerjee et al.; U.S. Pat. No. 5,593,792 to Farrier et al.; U.S. Pat. No. 5,595,577 to Bensalem et al.; U.S. Pat. No. 5,816,263 to Counts et al.; U.S. Pat. No. 5,819,751 to Barnes et al.; U.S. Pat. No. 6,095,153 to Beven et al.; U.S. Pat. No. 6,311,694 to Nichols et al.; and U.S. Pat. No. 6,367,481 to Nichols et al.; and PCT WO 97/48294 and PCT WO 98/16125. See, also, those types of commercially marketed cigarettes described *Chemical and Biological Studies on New Cigarette Prototypes that Heat Instead of Burn Tobacco*, R. J. Reynolds Tobacco Company Monograph (1988) and *Inhalation Toxicology*, 12:5, p. 1-58 (2000).

In the method of the present invention, a chemical reagent is introduced to the tobacco such that the chemical reagent has the ability to interact with the tobacco during the curing process. The tobacco can be contacted with the chemical reagent before or during the curing process. Although less preferred, the chemical reagent can be applied to the tobacco before, during or after harvest of the tobacco. The tobacco can be placed in contact with the chemical reagent after the tobacco has been placed in the curing structure, either before commencement or during the curing process. That is, the chemical reagent is provided from a source such that the chemical reagent is exogenous to the tobacco being treated, and the exogenous component is placed in contact with the tobacco in a manner such that the exogenous component has the ability to interact with the tobacco. Typically, the tobacco is contacted with the chemical reagent towards the latter stages of the yellowing stage of the curing process. Most preferably, the tobacco is contacted with the chemical reagent after the yellowing stage of the curing process has been completed, and during the period of time that heated air is circulated through the curing structure. Steps can be taken to examine the tobacco during the overall curing process in order to determine the appropriate time for introducing the tobacco to exposure with the chemical reagent.

The chemical reagent can be any chemical reagent capable of chemically reacting with tobacco during a curing process. Specifically, the chemical reagent should be a compound capable of reacting with a tobacco in a manner that alters the chemical nature of tobacco in a favorable way, such as by adjusting the concentration of certain compounds within a tobacco, such as tobacco alkaloids (e.g., nicotine) and/or certain carbohydrates.

The manner in which the reagent is introduced to the tobacco can vary. The chemical reagent may be in the form of a liquid, solid, or gas. A chemical reagent in liquid form, such as a reagent in aqueous form, can be sprayed onto the tobacco material prior to or during the curing process. A chemical reagent in liquid form, such as a reagent in aqueous form, can be positioned within the curing structure and allowed to evaporate during time periods when the tobacco material is exposed to heat during the curing process. Alternatively, the chemical reagent may contact the tobacco material in the form of a gas, which can be introduced into the environment surrounding the tobacco prior to or during the curing process, such as by introducing the gaseous reagent into the curing enclosure. A gaseous reagent can be introduced to the tobacco by using a volatile solid chemical reagent that releases a gaseous reagent over time. It is preferable to seal the curing chamber (e.g., close the doors, dampers and vents) for certain periods of time during introduction of the chemical reagent to the curing chamber, and during exposure of the tobacco to the chemical reagent.

The tobacco can be exposed to the chemical reagent during the curing process without taking steps to purposefully change the atmospheric conditions within the curing structure. That is, chemical reagent can be introduced into the curing structure during the curing process without taking further steps to alter the atmospheric pressure within the structure to any significant degree. Alternatively, steps can be taken, prior to and/or during exposure of the tobacco to the chemical reagent, to seal the structure to some degree and to either increase or decrease the atmospheric pressure within that structure. That is, it is possible to expose the tobacco to chemical reactant while that tobacco is located in a structure possessing an atmosphere that has either a positive or negative pressure than what would otherwise be the case during that period of the curing process.

Though much less preferred, the reagent can be introduced into the tobacco during the growing season by, for example, including the chemical reagent in a solid or liquid composition applied to the growing plants, such as a component of a fertilizer composition. However, it is most preferred to also introduce such a tobacco to an exogenous chemical reagent during the curing process.

The chemical reagent can vary. More than one chemical agent can be employed. Various chemical reagents can be employed at different times in carrying out the present invention. The tobacco also can be contacted with those types of components set forth in U.S. Pat. No. 6,564,808 to Hempfling et al. The chemical reagent can comprise nitrogen. The chemical reagent can have basic properties. The chemical reagent can include organic compounds, such as urea and various dibasic amino acids. The chemical reagent can include sources of ammonia (e.g., gaseous ammonia, liquid ammonium hydroxide and solid ammonium carbonate). The chemical reagent can have acidic properties, and can include mono-carboxylic and di-carboxylic organic acids having 1 to about 6 carbon atoms. Preferred chemical reagents having acidic properties volatilize under those conditions experienced within a curing structure during the tobacco curing process. An exemplary organic acid is acetic acid. The chemical reagent can be a flavor compound associated with the flavoring of tobacco, such as a compound reactive with tobacco or a component thereof, such as carbohydrates within the tobacco, and capable of forming flavorful and aromatic compounds or precursors thereof. See, Leffingwell et al., *Tobacco Flavoring for Smoking Products* (1972).

In one preferred embodiment, the chemical reagent is an ammonia source. The ammonia source can be any compound that provides ammonia available for reaction with the tobacco. Exemplary ammonia sources include aqueous ammonia sources such as ammonium hydroxide solutions, gaseous ammonia, and a solid ammonia source, such as ammonium carbonate, that releases gaseous ammonia. Another exemplary ammonia source is ammonium nitrate. Exposure of tobacco to ammonia during curing can result in a reduction of the nicotine content of the tobacco, and also can result in an increase in the amino sugar content of the tobacco. However, due to the volatility of ammonia, the process of the invention can be controlled in order to ensure that little or essentially no residual ammonia remains in intimate contact with the tobacco after curing is complete. A representative method suitable for determining the ammonia content of tobacco is set forth in Gales, *Evaluation of the Technicon Block Digestor System and the ammonia probe for the determination of TKN*, United States Environmental Protection Agency, National Environmental Research Center, (1975).

The method of contacting the ammonia source with the tobacco can vary. Liquid ammonia sources can be sprayed directly onto the tobacco leaves. Liquid ammonia sources can be contained in pans, and the ammonia can be allowed to evaporate from such a source. Gaseous ammonia sources can be introduced into the curing enclosure before or during curing in an amount sufficient to achieve a predetermined volumetric concentration within the enclosure for a predetermined period of time. Solid sources of ammonia, such as ammonium carbonate, can be located in the curing chamber (e.g., in air permeable sachets) in order that the ammonia can volatilize upon exposure to heat during the curing process. Alternatively, but in addition to the foregoing, an ammonia source is introduced to the tobacco as part of a fertilizer composition prior to harvest. Virtually any method of contacting the tobacco with the ammonia source can be used in order to supply ammonia to the surface of the tobacco or to within the tobacco material at some point during the curing process.

The amount of chemical reagent employed in the process of the invention can vary depending on the nature of the desired chemical reaction that will occur on or in the tobacco, the extent of the chemical change desired in the tobacco (e.g., the amount of nicotine reduction), and the manner in which the chemical reagent will be applied to the tobacco. When the chemical reagent is added to the curing enclosure in gaseous form, it is preferable to achieve a volumetric concentration of that chemical reagent within the atmosphere within the enclosure of the curing structure about 0.1% to about 10%, more preferably about 0.3 to about 5.0%, most preferably about 0.5 to about 2.5%.

The length of the reaction time between the chemical reagent and the tobacco can also vary. In some applications, it is desirable to allow the reagent and the tobacco to react during the entire curing process. In other applications, it will be desirable to limit the reaction time to a defined period of time during the curing process. For example, for certain volatile gaseous reagents such as ammonia, it is preferable to limit the reaction time to about 5 minutes to about 5 hours, more preferably about 10 minutes to about 2 hours, most preferably about 20 minutes to about 60 minutes. The time of reaction can be limited to a predetermined interval by, for example, evacuating the curing enclosure in order to remove a gaseous reagent or by spraying the tobacco with an inert liquid, such as water, to remove a liquid reagent.

The amount of reactant that interacts with the tobacco can vary. For a chemical reactant having the form of ammonia, the amount of ammonia that interacts with the tobacco to which it is exposed to elicit some chemical change within that tobacco frequently can exceed about 0.001%, often can exceed about 0.005%, sometimes can exceed about 0.01%, and occasionally can exceed about 0.02%, based on the dry weight of the tobacco to which that chemical reactant is exposed. For a chemical reactant having the form of ammonia, the amount of ammonia that interacts with the tobacco to which it is exposed to elicit some chemical change within that tobacco frequently does not exceed about 0.5%, often does not exceed about 0.4%, sometimes does not exceed about 0.3%, and occasionally does not exceed about 0.2%, based on the dry weight of the tobacco to which that chemical reactant is exposed. That is, it is preferable that sufficient chemical reactant interacts with the tobacco to cause alteration, modification or change in the overall chemical composition, character or nature of the tobacco that would be greater than, or in addition to, those changes that occur within tobacco during a normal curing process.

When other volatile compounds, such as volatile organic acids or certain other flavoring agents, are employed as chemical reagents, the amounts of those compounds employed and conditions under which those compounds are contacted with the tobacco are comparable to those described with reference to the use of an ammonia source as a chemical reagent. For such compounds, the specific amounts that are used can vary and can be determined by routine experimentation. The particular properties of the cured tobacco provided using such compounds and reaction conditions can be a matter of design choice.

When a gaseous chemical reagent is used, it is preferable to determine the "leak rate" in the curing enclosure in order to accurately gauge the amount of gaseous reagent that will be required to achieve a predetermined average concentration in the enclosure over a predetermined period of time (i.e., to determine the gas flow rate exiting the curing enclosure). One method for determining the leak rate of a curing enclosure involves the use of carbon dioxide as a tracer gas. In this method, carbon dioxide is introduced into the enclosure, such as through a ventilation/recirculation fan. The concentration of carbon dioxide is measured in the center of the enclosure using, for example, a Horiba model APBA-210 carbon dioxide analyzer. Gas concentrations are recorded at periodic intervals, such as every thirty seconds. The leak rate is determined from the decay of the carbon dioxide concentration in the enclosure. Adjustments can be made to reflect the fact that ambient air contains approximately 300 ppm of carbon dioxide. Once the leak rate is determined, it is possible to determine the amount of gaseous reagent required to reach a certain average volumetric concentration within the curing enclosure for a predetermined period of time. See, for example, Heinsohn, *Industrial Ventilation: Engineering Principles*, 228-264 (1991), which is incorporated herein by reference. When using gaseous reagents or reagents in gaseous forms it is preferable to reduce the leak rate if possible in order to minimize the amount of reagent required to achieve the desired volumetric concentration in the curing enclosure. Methods for reducing the leak rate from the curing enclosure include sealing intake air dampers and exhaust vents with tape.

Tobaccos cured in accordance with certain aspects of the present invention can have nicotine contents that are reduced relative to similar tobaccos that are similarly cured without exposure to effective amounts of certain chemical reagents during cure. Certain tobaccos cured in accordance with certain aspects of the present invention can possess nicotine contents that typically are at least about 5% less, generally are at least about 10% less, and sometimes are at least about 15% less relative to similar tobaccos that are similarly cured without exposure to effective amounts of certain chemical reagents (e.g., basic compounds, such as ammonia) during cure. Certain tobaccos cured in accordance with certain aspects of the present invention can possess nicotine contents that typically are up to about 20%, generally up to 25%, and sometimes up to about 30% reduced relative to similar tobaccos that are similarly cured without exposure to effective amounts of certain chemical reagents (e.g., basic compounds, such as ammonia) during cure. As such, the present invention provides an efficient and effective manner or method for removing certain amounts of nicotine from the tobacco during curing process steps, and for producing a cured tobacco having reduced nicotine content.

Tobaccos cured so as to have reduced nicotine contents can be cured under controlled curing conditions. Those tobaccos can be cured in accordance with the present invention. Additionally, those tobaccos can be cured so as to have reduced sugar contents. One manner for providing a tobacco having a reduced sugar content involves subjecting that tobacco to a yellowing period that is relatively long, or that is extended relative to a normal yellowing period, and then exposing that tobacco to an ammonia source during some portion of the time period that the tobacco is exposed to heating at elevated temperatures relative to ambient temperature. However, it is highly advantageous that for tobaccos that are cured in accordance with the present invention, the weight of nicotine present in the cured tobacco relative to the weight of total sugars present in that cured tobacco exceeds about 1, more preferably exceeds about 2, and most preferably exceeds about 2.5.

Tobaccos cured in accordance with the present invention possess good chemical and physical properties. The tobaccos preferably possess a moisture content that can be considered uniform, and are not overly dry (and hence are suitable for reordering). Most preferably, the color of the cured tobacco is acceptable; that is, the cured tobacco can have a yellow, orange or brown color, and the tobacco most preferably is not subjected to reaction to such a degree that it turns black. The physical integrity of the cured tobacco is very good, and the tobaccos are not overly brittle. The tobacco can be further handled and aged in a conventional manner. The tobaccos exhibit a desirable aroma, and possess sugar contents that are in a desirable range (e.g., sugar contents of about 6% to about 20%, on a dry weight basis). The smoking quality of such tobaccos is at least comparable to that of similar tobaccos that are cured using traditionally employed curing techniques.

Tobaccos can be cured in essentially conventional manners after harvest. Tobaccos can be cured in traditional manners using conventional equipment, techniques and curing conditions. There is no need to cure the tobacco at specially selected and controlled periods of time after harvest. Curing times, curing temperatures and other well established curing conditions (e.g., airflow) can be virtually identical to those that have been traditionally used in North America. As such, it is not necessary to take special care to control time, tobacco moisture level, tobacco physical character, or cell integrity within the tobacco. A virtually one-step curing process can be employed; that is, the tobacco can be cured for a period of about 120 to about 200 hours in an essentially uninterrupted fashion, and it is possible that any interruption for addition of chemical reagent can be carried out in a relatively non-intrusive manner. Tobacco can be cured without unusual interruptions in the curing process with the possible exception of the short periods of time needed to introduce the chemical reagent to the tobacco and/or to evacuate or remove the chemical reagent from the tobacco and/or curing enclosure. Using the process of the present invention, the tobacco can be observed during cure; that is, yellowing and drying can be observed and monitored. Normal periods of curing stages, temperature increase ramp rates, and curing completion times can be employed. Thus, many of the aspects of the art of tobacco curing are maintained and are not significantly affected as a result of the present invention. The process of the present invention can be readily employed in an essentially traditional manner by those who have had experience in growing and curing tobaccos.

EXPERIMENTAL

The present invention is more fully illustrated by the following examples, which are set forth to illustrate the present invention and are not to be construed as limiting thereof. In the following examples, mg means micrograms and mg means milligrams. In the example below, the cured tobaccos were evaluated for one or more of the following: nicotine content, sugar content, total amino sugar content, and aspargino-D-fructose content. The analytical techniques that can be employed are generally of the type set forth in Severson et al., *J. Chrom.* 21, 111-121 (1981), using either chloroform or methyl t-butyl ether as a solvent; Federal Register/Volume 62, No. 85/Friday, May 2, 1997/Notices pages 24116-24119; Dept. of Health & Human services, Centers for Disease Control & Prevention, *Protocol to Measure the Quantity of Nicotine Contained in Smokeless Tobacco Products Manufactured, Imported, or Packaged in the United States*; U.S. Pat. No. 6,428,624 to Coleman et al.; Dominguez et al., 54$^{th}$ Tobacco Science Research Conference, Presentation No. 75 (2000); and Henderson et al., *Rapid, Accurate, Sensitive, and Reproducible HPLC Analysis of Amino Acids*, Agilent Technologies Technical Note.

EXAMPLE 1

Two tobacco curing barns were loaded with about 575 pounds of freshly harvested green lower stalk Virginia tobacco. Each barn possessed an area for positioning the tobacco of about 4 feet wide, about 5 feet high and about 4 feet deep. The barns each contained 6 racks for containing the tobacco; and each rack was about 47 inches wide, about 5 feet high and about 18 inches deep.

The tobacco in each barn was subjected to curing conditions. In the control barn, the curing schedule was as follows: yellowing stage, about 54 total hours at about 35° C.; wilting stage, 1° C. temperature increase per hour to about 38° C. and maintained for a total wilting time of about 24 hours; leaf drying stage, 1° C. temperature increase per hour to about 44° C. and maintained for total leaf drying time of about 36 hours; stem (i.e., midrib) drying, 1° C. temperature increase per hour to about 57° C., and maintained for a total stem drying term of about 24 hours. Total cure time was about 138 hours. In the other barn, the curing schedule was as follows: yellowing stage, about 136 total hours at about 35-37° C.; wilting stage, 1° C. temperature increase per hour to about 38° C. and maintained for a total wilting time of about 9 hours; leaf drying stage, 1° C. temperature increase per hour to about 44° C. and maintained for total leaf drying time of about 12 hours; stem (i.e., midrib) drying, 1° C. temperature increase per hour to about 57° C., and maintained for a total stem drying term of about 24 hours. Total cure time was about 181 hours. At the end of the 136$^{th}$ hour of yellowing, sufficient gaseous ammonia was introduced into the barn in order to provide a barn atmosphere comprising about 1.8% by volume ammonia for 20 minutes. The barn was then evacuated (i.e., doors opened) to remove the residual ammonia, and curing was resumed.

For each barn, following curing, the heat was turned off, the doors of the barn were opened, and the tobacco was allowed to reorder as a result of contact with ambient air. The tobacco then was removed from the barns.

The color of the tobacco exposed to ammonia during cure was a slightly darker gold color as compared to the control tobacco (i.e., tobacco not exposed to ammonia during cure). The odor of the tobacco treated with ammonia during cure had an odor that can be characterized as more rich, malty and toasted, as compared to the control tobacco.

The tobacco collected from each barn was evaluated for moisture, total sugars, amino sugars and aspargino-D-fructose content. The tobacco exposed to ammonia was determined to have a nicotine content of about 2.61%, a total sugars content of about 7.3%, about 0.897 μg/mg of total amino sugars; and about 2.55 μg/mg of asparagino-D-fructose. The control sample was determined to have a nicotine content of about 4.14%, a total sugars content of about 11.9%; about 0.170 μg/mg of total amino sugars; and about 1.66 μg/mg of asparagino-D-fructose.

EXAMPLE 2

Three tobacco curing barns of the type generally described in Example 1 were loaded with about 575 pounds of freshly harvested green middle stalk Virginia tobacco. The tobacco in each barn was subjected to curing conditions. In the control barn, the curing schedule was as follows: yellowing stage, about 68 total hours at about 35° C.; wilting stage, 1° C. temperature increase per hour to about 42° C. and maintained for a total wilting time of about 34 hours; leaf drying stage, 1° C. temperature increase per hour to about 48° C. and maintained for total leaf drying time of about 24 hours; stem (i.e., midrib) drying, 1° C. temperature increase per hour to about 58° C., and maintained for a total stem drying term of about 24 hours. Total cure time was about 150 hours. In each of two experimental barns, the curing schedule was as follows: yellowing stage, about 65 total hours at about 28-37° C.; wilting stage, 1° C. temperature increase per hour to about 42° C. and maintained for a total wilting time of about 24 hours; leaf drying stage, 1° C. temperature increase per hour to about 48° C. and maintained for total leaf drying time of about 24 hours; stem (i.e., midrib) drying, 1° C. temperature increase per hour to about 58° C., and maintained for a total stem drying term of about 30 hours. Total cure time was about 143 hours.

At the end of the 65$^{th}$ hour of yellowing, sufficient gaseous ammonia was introduced into the first experimental barn in order to provide a barn atmosphere comprising about 0.5% by volume ammonia for 20 minutes and sufficient gaseous ammonia was introduced into the second experimental barn in order to provide a barn atmosphere comprising about 2.0% by volume ammonia for 20 minutes. The experimental barns were then evacuated (i.e., doors opened) to remove the residual ammonia and curing was resumed.

For each barn, following curing, the heat was turned off, the doors of the barn were opened, and the tobacco was allowed to reorder as a result of contact with ambient air. The tobacco then was removed from the barns.

The tobacco collected from each barn was evaluated for moisture, total sugars, amino sugars and aspargino-D-fructose content. The tobacco exposed to 0.5% ammonia was determined to have a nicotine content of about 3.55%, a total sugars content of about 12.3%, and about 0.844 μg/mg of total amino sugars. The tobacco exposed to 2.0% ammonia was determined to have a nicotine content of about 2.78%, a total sugars content of about 16.78%; about 1.30 μg/mg of total amino sugars; and about 9.34 μg/mg of asparagino-D-fructose. The control sample was determined to have a nicotine content of about 3.75%, a total sugars content of about 6.5%; about 0.272 μg/mg of total amino sugars; and about 4.05 μg/mg of asparagino-D-fructose.

EXAMPLE 3

Two tobacco curing barns of the type generally described in Example 1 were loaded with about 575 pounds of freshly harvested green middle stalk Virginia tobacco. The tobacco in each barn was subjected to curing conditions. The curing schedule for both barns was as follows: yellowing stage, about 173 total hours at about 23-37° C.; wilting stage, 1° C. temperature increase per hour to about 37° C. and maintained for a total wilting time of about 12 hours; leaf drying stage, 1° C. temperature increase per hour to about 43° C. and maintained for total leaf drying time of about 12 hours; stem (i.e., midrib) drying, 1° C. temperature increase per hour to about 57° C., and maintained for a total stem drying term of about 24 hours. Total cure time was about 221 hours.

In the experimental barn, at the end of the 163$^{rd}$ hour of yellowing, sufficient gaseous ammonia was introduced into the barn in order to provide a barn atmosphere comprising about 2.0% by volume ammonia for 20 minutes. The barn was then evacuated (i.e., doors opened) to remove the residual ammonia and curing was resumed.

For each barn, following curing, the heat was turned off, the doors of the barn were opened, and the tobacco was allowed to reorder as a result of contact with ambient air. The tobacco then was removed from the barns.

The tobacco collected from each barn was evaluated for moisture, total sugars, amino sugars and aspargino-D-fructose content. The tobacco exposed to ammonia was determined to have a nicotine content of about 3.46%, a total sugars content of about 8.9%, about 2.68 μg/mg of total amino sugars; and about 2.72 μg/mg of asparagino-D-fructose. The control sample was determined to have a nicotine content of about 3.45%, a total sugars content of about 11.9%; about 0.109 μg/mg of total amino sugars; and about 0.592 μg/mg of asparagino-D-fructose.

EXAMPLE 4

Two tobacco curing barns of the type generally described in Example 1 were loaded with about 575 pounds of freshly harvested green upper stalk Virginia tobacco. The tobacco in each barn was subjected to curing conditions. The curing schedule for both barns was as follows: yellowing stage, about 96 total hours at about 23-32° C.; wilting stage, 1° C. temperature increase per hour to about 38° C. and maintained for a total wilting time of about 32 hours; leaf drying stage, 1° C. temperature increase per hour to about 44° C. and maintained for total leaf drying time of about 28 hours; stem (i.e., midrib) drying, 1° C. temperature increase per hour to about 57° C., and maintained for a total stem drying term of about 32 hours. Total cure time was about 188 hours.

In the experimental barn, at the end of the $107^{th}$ hour of yellowing, sufficient gaseous ammonia was introduced into the barn in order to provide a barn atmosphere comprising about 2.0% by volume ammonia for 20 minutes. The barn was then evacuated (i.e., doors opened) to remove the residual ammonia and curing was resumed.

For each barn, following curing, the heat was turned off, the doors of the barn were opened, and the tobacco was allowed to reorder as a result of contact with ambient air. The tobacco then was removed from the barns.

The tobacco collected from each barn was evaluated for nicotine, total sugars, amino sugars and aspargino-D-fructose content. The tobacco exposed to ammonia was determined to have a nicotine content of about 3.63%, a total sugars content of about 8.4%, about 2.50 μg/mg of total amino sugars, and about 5.65 μg/mg of asparagino-D-fructose. The control sample was determined to have a nicotine content of about 3.37%, a total sugars content of about 9.4%; about 0.912 μg/mg of total amino sugars; and about 4.51 μg/mg of asparagino-D-fructose.

EXAMPLE 5

Two tobacco curing barns of the type generally described in Example 1 were loaded with about 575 pounds of freshly harvested green middle stalk Virginia tobacco. The tobacco in each barn was subjected to curing conditions. The curing schedule for both barns was as follows: yellowing stage, about 173 total hours at about 23-37° C.; wilting stage, 1° C. temperature increase per hour to about 37° C. and maintained for a total wilting time of about 12 hours; leaf drying stage, 1° C. temperature increase per hour to about 43° C. and maintained for total leaf drying time of about 12 hours; stem (i.e., midrib) drying, 1° C. temperature increase per hour to about 57° C., and maintained for a total stem drying term of about 24 hours. Total cure time was about 221 hours.

In the experimental barn, at the end of the $163^{rd}$ hour of yellowing, sufficient gaseous ammonia was introduced into the barn in order to provide a barn atmosphere comprising about 2.0% by volume ammonia for 20 minutes. The barn was then evacuated (i.e., doors opened) to remove the residual ammonia and curing was resumed.

For each barn, following curing, the heat was turned off, the doors of the barn were opened, and the tobacco was allowed to reorder as a result of contact with ambient air. The tobacco then was removed from the barns.

The tobacco collected from each barn was evaluated for moisture, total sugars, amino sugars and aspargino-D-fructose content. The tobacco exposed to ammonia was determined to have a nicotine content of about 2.78%, a total sugars content of about 16.7%, about 1.24 μg/mg of total amino sugars; and about 6.00 μg/mg of asparagino-D-fructose. The control sample was determined to have a nicotine content of about 3.75%, a total sugars content of about 6.5%; about 0.37 μg/mg of total amino sugars; and about 3.18 μg/mg of asparagino-D-fructose.

Filtered and air diluted cigarettes were prepared from each of the tobaccos cured under the curing treatment conditions and the control conditions. The cigarettes were smoked by sensory panelists. Both cigarettes were adjudged as having good smoking quality. The cigarette manufactured using the tobacco treated with ammonia during curing was adjudged as having less strength, being smoother, having a blander flavor, and having higher overall quality, versus the control cigarette manufactured using the tobacco cured under the control conditions.

Many modifications and other embodiments of the invention will come to mind to one skilled in the art to which this invention pertains having the benefit of the teachings presented in the foregoing description. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

What is claimed is:

1. A method of chemically modifying a tobacco material during a curing process, comprising:

providing a tobacco material;

placing the tobacco material in a curing enclosure;

curing the tobacco material under conditions of temperature and for a time sufficient to produce cured tobacco;

providing a gaseous source of ammonia; and contacting the tobacco material with the ammonia, in an amount and under conditions such that the ammonia interacts chemically with the tobacco material during curing.

2. The method of claim 1, wherein the tobacco material that is placed in the curing enclosure is green Virginia tobacco.

3. The method of claim 2, wherein the tobacco material that is placed in the curing enclosure is subjected to flue-curing conditions.

4. The method of claim 3, wherein the tobacco is heated at temperatures between about 35° C. and about 75° C. for about 120 hours to about 200 hours.

5. The method of claim 2, wherein the tobacco material is subjected to yellowing.

6. The method of claim 1, wherein the tobacco material is subjected to yellowing, and then is subjected to exposure to heated air.

7. The method of claim 1, wherein the ammonia is employed in an effective amount and under conditions sufficient to remove nicotine from the tobacco material during curing.

8. The method of claim 1, wherein the ammonia is employed in an effective amount and under conditions sufficient to result in reaction with carbohydrates within the tobacco material during curing.

9. The method of claim 1, wherein the tobacco material is subjected to yellowing, and the tobacco material is contacted with the ammonia after yellowing is complete, and heating of the tobacco material is commenced.

10. The method of claim 1, wherein the average concentration of ammonia within the atmosphere of the curing enclosure is about 0.1% to about 10% of the volume of the atmosphere within the curing enclosure.

11. The method of claim 1, wherein the average concentration of ammonia within the atmosphere of the curing enclosure is about 0.3% to about 5% of the volume of the atmosphere within the curing enclosure.

12. The method of claim 1, wherein the gaseous source of ammonia is introduced into the enclosure over a time period that ranges from about 5 minutes to about 5 hours.

13. The method of claim 1, wherein the ammonia exceeds about 0.001% of the dry weight of the tobacco material.

14. The method of claim 1, wherein the ammonia exceeds about 0.005% of the dry weight of the tobacco material.

15. The method of claim 1, wherein the ammonia exceeds about 0.01% of the dry weight of the tobacco material.

16. The method of claim 1, wherein the ammonia does not exceed about 0.5% of the dry weight of the tobacco material.

17. The method of claim 1, wherein the gaseous source of ammonia is provided by introducing ammonia-containing gas into the enclosure, evaporating a liquid ammonia source placed in the enclosure, or volatilizing a solid ammonia source placed in the enclosure.

18. A method of chemically modifying a tobacco material during a curing process, comprising:

providing a tobacco material;

placing the tobacco material in a curing enclosure;

curing the tobacco material under conditions of temperature and for a time sufficient to produce cured tobacco, wherein the curing step includes a yellowing stage during which the tobacco material is yellowed;

providing a gaseous source of ammonia; and contacting the tobacco material with the ammonia after the tobacco is yellowed in an amount and under conditions such that the ammonia interacts chemically with the tobacco material during curing.

19. The method of claim 18, wherein the tobacco material that is placed in the curing enclosure is green Virginia tobacco.

20. The method of claim 19, wherein the tobacco material that is placed in the curing enclosure is subjected to flue-curing conditions.

21. The method of claim 18, wherein the tobacco material is subjected to yellowing, and then is subjected to exposure to heated air.

22. The method of claim 18, wherein the tobacco is heated at temperatures between about 35° C. and about 75° C. for about 120 hours to about 200 hours.

23. The method of claim 18, wherein the ammonia is employed in an effective amount and under conditions sufficient to remove nicotine from the tobacco material during curing.

24. The method of claim 18, wherein the ammonia is employed in an effective amount and under conditions sufficient to result in reaction with carbohydrates within the tobacco material during curing.

25. The method of claim 18, wherein the average concentration of ammonia within the atmosphere of the curing enclosure is about 0.3% to about 5% of the volume of the atmosphere within the curing enclosure.

26. The method of claim 18, wherein the ammonia is introduced into the enclosure over a time period that ranges from about 5 minutes to about 5 hours.

27. The method of claim 18, wherein the ammonia exceeds about 0.001% of the dry weight of the tobacco material.

28. The method of claim 18, wherein the ammonia exceeds about 0.005% of the dry weight of the tobacco material.

29. The method of claim 18, wherein the ammonia exceeds about 0.01% of the dry weight of the tobacco material.

30. The method of claim 18, wherein the ammonia does not exceed about 0.5% of the dry weight of the tobacco material.

31. The method of claim 18, wherein the gaseous source of ammonia is provided by introducing ammonia-containing gas into the enclosure, evaporating a liquid ammonia source placed in the enclosure, or volatilizing a solid ammonia source placed in the enclosure.

32. A method of chemically modifying a tobacco material during a curing process, comprising:

providing a tobacco material;

placing the tobacco material in a curing enclosure;

curing the tobacco material under conditions of temperature and for a time sufficient to produce cured tobacco, wherein the curing step includes a yellowing stage during which the tobacco material is yellowed;

providing a gaseous source of ammonia; and contacting the tobacco material with the gaseous source of ammonia after the tobacco is yellowed in an amount and under conditions such that the ammonia interacts chemically with the tobacco material during curing, wherein the amount of ammonia is sufficient to produce an average concentration of ammonia within the atmosphere of the curing enclosure of about 0.1% to about 10% of the volume of the atmosphere within the curing enclosure.

33. The method of claim 32, wherein the tobacco material that is placed in the curing enclosure is green Virginia tobacco.

34. The method of claim 32, wherein the tobacco material that is placed in the curing enclosure is subjected to flue-curing conditions.

35. The method of claim 32, wherein the tobacco is heated at temperatures between about 35° C. and about 75° C. for about 120 hours to about 200 hours.

36. The method of claim 32, wherein the ammonia is employed in an effective amount and under conditions sufficient to remove nicotine from the tobacco material during curing.

37. The method of claim 32, wherein the ammonia is employed in an effective amount and under conditions sufficient to result in reaction with carbohydrates within the tobacco material during curing.

38. The method of claim 32, wherein the ammonia is introduced into the enclosure over a time period that ranges from about 5 minutes to about 5 hours.

39. The method of claim 32, wherein the amount of ammonia that reacts with the tobacco material exceeds about 0.001% of the dry weight of the tobacco material.

40. The method of claim 32, wherein the ammonia that reacts with the tobacco material exceeds about 0.005% of the dry weight of the tobacco material.

41. The method of claim 32, wherein the ammonia that reacts with the tobacco material exceeds about 0.01% of the dry weight of the tobacco material.

42. The method of claim 32, wherein the gaseous source of ammonia is provided by introducing ammonia-containing gas into the enclosure, evaporating a liquid ammonia source placed in the enclosure, or volatilizing a solid ammonia source placed in the enclosure.

43. The method of claim 32, wherein the ammonia that reacts with the tobacco material does not exceed about 0.5% of the dry weight of the tobacco material.

* * * * *